US010862256B2

(12) United States Patent
Sundermeier et al.

(10) Patent No.: US 10,862,256 B2
(45) Date of Patent: Dec. 8, 2020

(54) PLUG CONNECTOR COMPRISING JUMPERS

(71) Applicant: HARTING Electric GmbH & Co. KG, Espelkamp (DE)

(72) Inventors: Uwe Sundermeier, Espelkamp (DE); Andre Beneke, Vechta (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/469,715

(22) PCT Filed: Aug. 6, 2018

(86) PCT No.: PCT/DE2018/100687
§ 371 (c)(1),
(2) Date: Jun. 14, 2019

(87) PCT Pub. No.: WO2019/042492
PCT Pub. Date: Mar. 7, 2019

(65) Prior Publication Data

US 2020/0091669 A1 Mar. 19, 2020

(30) Foreign Application Priority Data

Aug. 31, 2017 (DE) ..... 10 2017 120 095

(51) Int. Cl.
*H01R 31/08* (2006.01)
*H01R 13/424* (2006.01)
(Continued)

(52) U.S. Cl.
CPC ..... *H01R 31/08* (2013.01); *H01R 13/424* (2013.01); *H01R 13/506* (2013.01); *H01R 13/6315* (2013.01)

(58) Field of Classification Search
CPC .... H01R 31/08; H01R 13/424; H01R 13/506; H01R 13/6315; H01R 12/712;
(Continued)

(56) References Cited

U.S. PATENT DOCUMENTS 5,476,392 A 12/1995 Inaba et al.
5,658,162 A 8/1997 Harting et al.
(Continued)

FOREIGN PATENT DOCUMENTS

CN 202797560 U 3/2013
CN 203895673 U 10/2014
(Continued)

*Primary Examiner* — Nguyen Tran
*Assistant Examiner* — Paul D Baillargeon
(74) *Attorney, Agent, or Firm* — Smartpat PLC

(57) ABSTRACT

For ease and modification flexibility in the manufacture of jumpers in a plug connector, according to the invention the housing cover (10) is equipped with a contact carrier (3) which is releasably clipped thereon. The contact carrier (3) can be made in two parts and can have an upper part (1) and a lower part (32). These can be separated from one another and joined together in order to accommodate individual U-shaped contact pins (8, 8', 8") for bridging socket contacts (28) of the plug connector or also in order to remove and/or replug said pins. If necessary, the complete contact carrier (3) can also be exchanged for another contact carrier having a different bridge assignment. As a result, the operating state of an electrical system can be individually defined and modified. When the housing cover is open, an external test plug can be plugged in for maintenance purposes. Furthermore, the contact carrier (3) can have a certain mechanical "play" for tolerance compensation in the housing cover (10) so that the contact pins (8, 8', 8") and the contact carrier (3) are not subjected to mechanical stresses during opening and closing of the housing cover (10).

21 Claims, 11 Drawing Sheets

(51) Int. Cl.
*H01R 13/506* (2006.01)
*H01R 13/631* (2006.01)

(58) Field of Classification Search
CPC .... H01R 29/00; H01R 13/64; H01R 13/6456; H01R 13/6271; B66B 29/00
See application file for complete search history.

(56) References Cited

U.S. PATENT DOCUMENTS

| | | | | |
|---|---|---|---|---|
| 5,717,161 | A | 2/1998 | Wakata | |
| 2005/0233634 | A1 | 10/2005 | Kollmann | |
| 2014/0057483 | A1 | 2/2014 | Reineke | |
| 2014/0158395 | A1* | 6/2014 | Billman ..... | H02B 7/00 174/68.2 |

FOREIGN PATENT DOCUMENTS

| | | | |
|---|---|---|---|
| DE | 2451662 | A1 | 5/1976 |
| DE | 8121654 | U1 | 10/1981 |
| DE | 69404001 | | 10/1997 |
| DE | 4413043 | C2 | 9/2000 |
| DE | 202011108572 | U1 | 1/2012 |
| DE | 102004018554 | | 9/2018 |
| EP | 0957540 | A2 | 11/1999 |
| EP | 0731534 | B1 | 12/1999 |
| JP | H06310227 | A | 11/1994 |
| JP | 2001110511 | A | 4/2001 |
| JP | 2013012437 | A | 1/2013 |
| KR | 19990015044 | U | 5/1999 |

* cited by examiner

PLUG CONNECTOR COMPRISING JUMPERS

TECHNICAL FIELD

The disclosure relates to a plug connector having a cover with integrated jumpers. The disclosure further relates to a method for changing the operating state of an electrical system, in particular, an escalator, by reconfiguring a plug connector with integrated jumpers.

BACKGROUND

Plug connectors with jumpers are required in particular for carrying out maintenance work on electrical systems, for example, escalators.

Such plug connectors have been known in the prior art since approximately 1996. At such time, in cooperation with Compact Electric in Vienna, HARTING elektronische Bauelemente Ges.m.b.H. manufactured for Schindler (today's name: Schindler Fahrtreppen International GmbH) six-pole heavy-duty connectors with bulkhead housings, the bulkhead housings having pivotable housing covers, in particular, those that can be snapped open and shut. A printed circuit board with up to six contact pins soldered onto it is screwed into each of such swiveling housing covers. As a rule, such contact pins are connected to each other in pairs in an electrically conductive manner via a conductor track on the printed circuit board, and thus form an electrical jumper, often referred to as a "bridge" in its short form.

Furthermore, such connector has an insulating body in which six contact sockets are arranged. By closing the housing cover, for example, two of the contact sockets can be "bridged," that is, connected in an electrically conductive manner to each other by one of the bridges.

The contact pins belonging to a bridge, and thus also the contact sockets to be bridged opposite them, can be configured to corresponding pairs by the course of the conductor tracks on the printed circuit board. By changing the printed circuit board to another corresponding printed circuit board, such pairings can be adapted to the respective requirements.

By closing the housing cover, the electrical system (for example, the escalator) can be operated via the bridged contacts. Thus, the closed housing cover corresponds to the operating state. When the housing cover is open, operation is interrupted and a test plug can be plugged into the plug connector as a mating connector instead. Thus, the opened housing cover corresponds to the maintenance state.

The basic housing design of such plug connectors corresponds to the prior art at the time. For example, a comparable hinge joint mechanism of the housing cover has already been described in publication DE 24 51 662 A1. Furthermore, publication EP 0 731 534 A2 discloses a so-called "Easy-Lock" locking bracket that is thereby used, the side parts of which have pockets in which a spring element and a rocker-type locking element are arranged. Publication EP 0 957 540 B1, published somewhat later, which describes a connector housing with particularly good EMC (electromagnetic compatibility) protection, mentions, among other things, a sealing ring with which the plug connector housing can be sealed against the ingress of dust and moisture from a mating connector or from its own housing cover.

In practice, the functionality of a plug connector, with electrical jumpers arranged in its housing cover, has proven itself in principle. However, there has sometimes been criticism that the contact pins inserted into the contact sockets, together with the contact sockets, exert a certain mechanical moment on the printed circuit board during the pivoting movement of the housing cover, such that the printed circuit board is exposed to mechanical loads. Moreover, the implementation of a large number of bridges by a simple printed circuit board is at least more difficult or even no longer feasible. This is a particular disadvantage because such a bridge function is increasingly required for plug connectors with a larger number of contact pins, for example for ten-pole plug connectors.

In the current state of the art, an additional disadvantage is the assembly effort involved in changing the printed circuit board or the cost-intensive replacement of the complete housing cover, if the configuration of the bridges has to be changed.

Accordingly, the option of a comfortable and cost-effective change of the bridge assignment, for example for the change of the operating state, is desired. For some applications, a high current carrying capacity of the bridges is still required.

The German Patent and Trade Mark Office has searched the following prior art in the priority application for the present application: DE 81 21 654 U1, DE 44 13 043 A1, JP 2001-110511 A, DE 694 04 001 T2, JP 2013-12437 A, DE 10 2004 018 554 A1, DE 20 2011 108 572, U1 and US 2014/0057483 A1.

SUMMARY

A task of the disclosure is to present a robust device that allows an easy-to-handle switching between a maintenance state and an operating state of an electrical system (for example, an escalator). As many contact sockets of a plug connector as possible should be accessible to an external test plug during maintenance operation and can be bridged in pairs in the operating state. In particular, the configuration of the bridges should be easy and inexpensive to change.

This task is solved by the features of the independent claims.

A contact carrier serves to accommodate several U-shaped contact pins for the production of jumpers and is suitable for being releasably arranged in a housing cover of a plug connector. In particular, the contact carrier can be designed at least in two parts; that is, for example, it can be designed in two parts, three parts, four parts, . . . , n parts. In particular, the contact carrier can be designed at least in two parts, at least in three parts, at least in four parts . . . at least in n parts.

Advantageous designs of the invention are indicated in the dependent claims.

The contact carrier is advantageously made of an electrically insulating material, preferably plastic. The contact carrier can be released from the housing cover of the plug connector, and thereby preferably kept movable within a specified tolerance range. The U-shaped contact pins arranged in the contact carrier are used to produce electrical jumpers with respect to contact sockets, which are arranged in an insulating body of the plug connector. On the cable connection side, such contact sockets can be connected in an electrically conductive manner, for example, to components of an electrical system, in particular, an escalator.

Due to the multi-part (thus, at least two-part, for example at least three-part) shape of the contact carrier, it is advantageously possible that the paths of the U-shaped contact pins, which form the bridges (short form for "electrical jumpers"), cross inside the contact carrier. The U-shaped contact pins can be individually removed and/or inserted from the contact carrier (for example, by separating and joining the several parts of the contact carrier), in order to change the configuration inexpensively. For example, a particular bridge can be removed and/or added as needed with very little effort. At the same time, the U-shaped contact pins can have a relatively large cross-section compared to the conductor tracks of a printed circuit board. This is particularly advantageous because it significantly improves both the mechanical stability and the current carrying capacity of the bridges compared to the printed circuit board solution.

Of course, in a special design, the parts of the multi-part contact carrier can latch together and/or be can be bonded together after inserting the U-shaped contact pins. In the case of bonding, however, from this point on the possibility of removing it and thus the possibility of changing the configuration of such contact carrier is no longer available, or is at least severely restricted. The latching, on the other hand, also allows such contact carrier to be reconfigured later.

As soon as the contact carrier is arranged on the housing cover of the plug connector housing, the U-shaped contact pins are capable of being automatically introduced into the respective contact socket of the plug connector by closing/snapping shut, in particular by a pivoting movement, of the housing cover, and are thereby capable of electrically bridging in each case a pair of contact sockets provided for this purpose; that is, of connecting to each other, in an electrically conductive manner, the two contact sockets that form this pair.

In its use, the contact carrier is extremely advantageous compared to a solution with which simple contact pins are soldered to a printed circuit board or with which U-shaped contact pins are simply inserted into the housing cover and encapsulated, for example with a plastic compound.

In contrast, the multi-part contact carrier has the advantage, for example, that individual U-shaped contact pins can be manually removed from the contact carrier and/or inserted into it at any time. Thus, as will be explained later, the operating state of the electrical system (for example, the escalator) can also be changed.

Through a certain clearance of the contact carrier in relation to the housing cover in which it is held, mechanical tolerances can be created; these are necessary to be able to close (thus, snap shut) or open (thus, snap open) the housing cover of the plug connector housing without generating undesirable mechanical stresses, even while the U-shaped contact pins are, at least partially, inserted into the contact sockets of the plug connector. Thus, the solution according to the invention has the advantage that it is stable and flexible. This clearance can be achieved, for example, by arranging at least one, preferably two positioning pins with a circular cross-section in the housing cover. The contact body can have suitable positioning openings for accommodating such positioning pins, which positioning openings have a slot-like cross-section, wherein the minor axis is preferably aligned parallel to the axis of rotation of the housing cover and the major axis is preferably aligned perpendicular to it. This means that the contact carrier can have the specified tolerance in the pivoting direction of the housing cover, can be positioned perpendicular to it and at the same time can be held with its latching arms in the counter-latching arms of the housing cover.

Furthermore, the configuration of the bridges can be adapted at any time to a desired changed function of the operating state within the possibilities specified by the contact carrier, for example through a suitable replacement, arrangement, removal and/or addition of individual U-shaped contact pins to/from the contact carrier.

In a preferred design, the contact support can have, in addition to its specified at least two parts, a third part that can be attached to the interconnected parts, in particular, a cover that can be snapped onto it. For example, the contact carrier can have at least one upper part and one lower part and the specified cover, such that, in such case, the contact carrier is designed in at least three-part in total. Then, the upper part can be initially attached to the lower part. The cover can then be attached to the upper part and, in particular, fastened (for example, latched) to the lower part. For this purpose, the cover can, for example, have fastening clips with latching windows, with which it latches onto latching formations of the lower part. Through this latching, in a preferred design, the upper part can be held, on the one hand, at the lower part as well. On the other hand, it is particularly advantageous if the cover has a protective surface, with which it rests against the upper part in the attached state, and thus covers at least one or, if necessary, several contacts extending through the upper part, in particular through at least one contact support of the upper part. This protective surface reliably prevents manual contact, for example, with at least one current-carrying contact pin. Thus, the cover can fulfill a dual function, specifically both an electrical safety function and a mechanical, structural fastening function.

The electrical safety function is particularly advantageous because—at least theoretically and/or in the event of damage—when the housing cover of the plug connector is opened, there is a danger that the contact carrier releasably attached to it will, on the one hand, become unintentionally released from the housing cover, while, on the other hand, the contact pins accommodated therein are still inserted into the insulating body and are thus mechanically held there. Of course, this does not correspond to the intended use of the contact carrier; rather, it represents a possible source of danger in the event of incorrect operation or damage, since the contact pins can ultimately be in electrical contact with socket contacts arranged in the insulating body. In the worst case, at least one of such socket contacts, and thus also the contact pin connected to it, can even carry a life-threatening electrical voltage.

Through the specified cover of the contact carrier and in particular its protective surface, manual contact with this contact pin, also in such a case of failure, can be safely avoided. It is advantageous that such a danger through a fundamental operating error (for example, by untrained personnel who do not fasten the contact carrier in the cover but insert it directly into the insulating body in disregard of the relevant safety regulations) can be safely prevented.

In particular, it is particularly advantageous to bond a contact carrier that has been individually configured by the user (that is, provided with the desired U-shaped contact pins), and thereby in particular to bond its cover to the other parts, in particular to the upper and lower parts, because the cover can then no longer be removed.

In order to be able to change the bridge assignment even more flexibly (for example, to operate the plug connector with a converted system or to fundamentally change the operation of the system), in an advantageous design, a different contact carrier, which has the new, desired configuration, can of course be exchanged for the currently used contact carrier; that is, fastened in the housing cover instead of it. Thereby, new bridge connections are also made possible in a cost-effective and uncomplicated manner, for which no contact supports are provided in the contact carrier to be replaced.

Such an exchange of the contact carrier for another contact carrier can also be carried out very conveniently and cost-effectively by latching and positioning elements of the respective contact carrier and the housing cover. This variant is suitable, as described above, for example, if the contact carrier currently in use does not support the route of at least one particular desired bridge through its contact supports.

This method is particularly suitable for the use of bonded contact carriers, in particular, contact carriers with covers bonded for safety reasons.

In this manner, the user can individually configure different contact carriers with different bridge functions for an existing plug connection, and make them available for different applications.

It can be particularly advantageous to make the different contact carriers distinguishable with features, in particular optical features, in particular to design the contact carriers in different colors, in order to facilitate their assignment to the respective application (for example, escalator is to run upwards—contact carrier is green; escalator is to run downwards—contact carrier is red, etc.).

Alternatively or in addition, special assignments of the contact sockets could also be realized on the cable connection side, which, however, is sometimes undesirable in practice, for example, due to a basically fixed (for example, standardized) assignment of the contact sockets. In this case as well, the releasably fastened contact carrier offers an extremely flexible and at the same time easily operable solution, which is adapted to a specified assignment on the cable connection side in a manner that is easy-to-handle, flexible and cost-effective.

In the following, the particular advantages of the multi-part contact carrier are highlighted.

For example, a contact carrier for a ten-pole plug connector is suitable for accommodating five U-shaped contact pins, which then form a bridge between the contact socket pairs 5-10; 4-6; 1-7; 2-8; 3-9. If the bridge between the contact sockets 5-10 and the bridge between the contact sockets 2-8 is no longer desired, the corresponding U-shaped contact pins can be removed from the contact carrier with little effort through a suitable separation of individual parts of the contact carrier. Advantageously, the contact carrier is removed from the housing cover and then reattached to it, which is possible with very little effort given the common latching mechanism. Thereupon, when the housing cover is closed, only the contact socket pairs 4-6; 1-7; 3-9 are bridged.

If, for example, one of such bridges is needed again later, the previously removed U-shaped contact pin can be reinstalled into the contact carrier in the same manner with very little effort. This process of installing and removing individual contact bridges can be repeated non-destructively and almost as often as required by simply separating the individual parts of the contact carrier, which allows the user to change the configuration in an extremely flexible and particularly uncomplicated manner, if necessary in conjunction with the assignment on the cable connection side of the plug connector.

In particular, the two-part contact carrier consists of an upper part and a lower part, which can be joined together to form the contact carrier.

The technique described in the following therefore refers, as an example, to the advantageous design of a two-part contact body with the upper and lower parts. However, it is clear to the expert that this method can also be applied to any multi-part design, for example to a 3, 4, 5, . . . , n-part design of the contact carrier.

Both the upper part and the lower part can preferably have an essentially cuboid basic shape, and each can have a contact surface and a plug-in area opposite to it. When joining the upper and lower parts, the plug-in area of the upper part can be arranged on the contact surface of the lower part.

At least one elongated indentation can be arranged as a contact support in the contact surface of the upper part. The contact surface of the lower part can also contain at least one elongated indentation as a contact support. In total, the contact carrier, which is provided, for example, for use in the ten-pole plug connector, can have five contact supports. In a preferred design, the contact surface of the lower part can then have, for example, four contact supports, and the contact surface of the upper part can have one contact support accordingly. Some of the contact supports can have the same length. Some of the contact supports can also differ in length.

Both the upper part and the lower part can have through-holes at the ends of each contact support leading to the respective contact surface for contact passage, in particular for the passage of end areas on the plug side of the U-shaped contact pins. In addition, the lower part can have additional through-holes, which connect to the through-holes of the upper part when the contact carrier is in the joined stated. Thus, a U-shaped contact pin inserted into the contact support of the upper part with its end areas on the plug side can be guided both through the through-holes of the upper part and through the additional through-holes of the lower part, in order to fulfill its bridging function with respect to the respective contact sockets.

The upper part and lower part can have latching elements (for example, latching hooks and latching recesses) for mutual latching and unlatching. Such latching elements can also have a positioning function. Alternatively or in addition, the upper and lower parts can have separate positioning elements for mutual positioning in their joined state. For example, the upper part can have positioning pins in its plug-in area, and the lower part can have suitable positioning recesses in its contact surface. In a very special design, the upper and lower parts can also be bonded together after inserting the U-shaped contact pins; this increases stability but limits flexibility. Bonding does not have to be carried out in the factory; rather, it can also be carried out by the customer after the final configuration/assembly of the contact carrier has taken place, which means that the bridge assignment can still be individualized flexibly.

The contact carrier, on its part, can have polarization and latching elements. Thereby, the polarization elements can consist of a preferably L-shaped polarization element of the contact carrier, which can be formed on the contact carrier, for example on its upper part. The latching elements can consist of one or more latching arms of the contact carrier, which can be formed onto the lower part, for example. Such latching elements can latch to the counter-latching elements of the housing cover. In particular, the contact carrier can have latching arms that latch to the counter-latching arms of the housing cover. In addition, the housing cover can have positioning pins and the contact carrier can have positioning openings. This has the advantage that the contact carrier has a defined position in relation to the insulating body, such that the U-shaped contact pins held by it plunge into contact recesses of the insulating body in order to contact the contact sockets arranged therein. Between the positioning pins and the positioning openings, such play can exist to allow a slight tilting movement of the contact carrier relative to the housing cover.

The lower part can also have hollow-cylindrical formations at its plug-in area at the specified through-holes for mechanical guidance and better mutual electrical insulation of the end areas on the plug side of the U-shaped contact pins.

The U-shaped contact pins are advantageously made of an electrically conductive material, preferably metal, and in particular have a center area extending in a straight line, which advantageously has the same length as at least one contact support of the contact carrier. At both ends of the center area, the end areas on the plug side are bent at right angles. For this purpose, the U-shaped contact pins between the center area and the end areas on the plug side have a bending area, which naturally can exhibit a certain curvature. Thus, the center area of the U-shaped contact pins can be inserted into the respective contact support. The end areas on the plug side extending at right angles to the center area are simultaneously pluggable through the respective through-holes, such that they protrude from the lower part at the end on the plug side of the lower part for contacting the contact sockets. The at least one U-shaped contact pin, which is arranged at the upper part, can be led through the additional through-openings of the lower part. At the contact surface of the lower part, the end areas on the plug side of all U-shaped contact pins can project in this manner, and thereby can preferably be covered in sections by the specified hollow-cylindrical formations of such plug-in area, but protrude at their ends from it, in order to be inserted into the respective contact sockets.

U-shaped contact pins in various designs can be provided. These can be distinguished in particular by the length of their center area and/or the length of their end areas on the plug side. For use with a two-part contact carrier, which consists of an upper part and a lower part, the use of U-shaped contact pins, which differ from each other at least in the length of their end areas on the plug side, is suitable.

A first contact pin, which is intended for use in the upper part, advantageously has end areas that are longer than a second contact pin, which is intended for use in the lower part. Finally, the end areas of the first U-shaped contact pin must pass through two through-holes of the upper part along with two additional through-holes of the lower part and, if necessary, through the cylindrical formations of the lower part, and continue to project from the plug-in area of the lower part, in order to contact the contact sockets. The end areas of the second U-shaped contact pin only have to pass through the through-opening of the lower part and, if necessary, the cylindrical formations and protrude from the plug-in area in order to contact the respective contact sockets.

Furthermore, the U-shaped contact pins can differ in the length of their center areas. This determines the length of the bridge, which is specified by the distance between the respective contact sockets in the insulating body of the plug connector.

In this manner, a set of suitable U-shaped contact pins can be assembled for use with a particular contact carrier, of which at least some differ in their design. Preferably, at least two of such U-shaped contact pins differ in the length of their center areas and/or in the length of their end areas on the plug side.

The U-shaped contact pins inserted in the lower part can be fixed by joining them together and, if necessary, latching them to the upper part. The at least one U-shaped contact pin inserted in the upper part can be fixed by attaching the contact carrier in the housing cover.

The plug connector can have at least the following:

- a bulkhead housing with the housing cover held on it in a manner that can be snapped open and shut;
- an insulating body with the contact sockets arranged therein;
- a locking mechanism for locking the housing cover in a snapped-shut state.

As already mentioned, the contact carrier can be releasably fixed, in particular locked, in the housing cover.

For this purpose, the contact carrier can have latching arms, which are able to latch in a releasable manner with counter-latching arms of the housing cover.

By snapping shut the housing cover, at least one contact pin with its two end areas can be inserted into two of the contact sockets, in order to connect them in an electrically conductive manner; that is, to bridge them.

As already mentioned, the contact carrier can have a polarization element, for example, an L-shaped polarization element. The insulating body can be equipped with a suitable counter-polarization element, for example, a polarization recess, in which the polarization element of the contact carrier automatically engages when the housing cover is closed. On the opposite side, the insulating body can have an additional counter-polarization element, for example, a polarization bar, which prevents the housing cover from closing if the contact body is aligned incorrectly relative to the insulating body.

The contact carrier can be movably fixed in the housing cover within a specified mechanical tolerance range, in order to be able to snap open or snap shut the housing cover of the plug connector housing without producing undesirable mechanical stresses, even while the at least one U-shaped contact pin is inserted at least partially into the contact sockets of the plug connector on the plug side, in particular with its ends on the plug side. Finally, the end areas on the plug side of the U-shaped contact pins naturally move longitudinally into the contact sockets, while the housing cover performs a rotation/swivel movement during closing and opening. The specified mechanical tolerances between the contact carrier and the housing cover allow such two movements without mechanical stresses arising.

Such a plug connector can be installed as a measuring interface in an electrical system, such as an escalator. For this purpose, at least two electrical components of the system, which are to be connected to each other in an electrically conductive manner in the operating state, are attached to the plug connector on the cable connection side; that is, each is connected in an electrically conductive manner to one of the contact sockets of the plug connector. The operating state can be switched off by opening the housing cover; that is, the electrical components are no longer connected to each other in an electrically conductive manner. In this state, a test plug of a measuring system can be plugged into the plug connector and the components can be tested separately; that is, electrically decoupled from each other. The test plug can be removed and the housing cover can be closed again to establish the operating state. The respective contact sockets are thus bridged once again, and the electrical components of the system attached to them are once again connected to each other in an electrically conductive manner.

Occasionally, however, it can also occur that the operating state is to be changed, that electrical components of the system are replaced and/or the pin assignment changes, etc., such that it is necessary to change the configuration of the bridges in the contact carrier.

For this purpose, in an advantageous design, the contact carrier can be exchanged for another contact carrier with the desired configuration with only little effort.

In many cases, however, it is sufficient to modify the configuration of the contact carrier as follows in order to change the operating state of the electrical system:

A. Releasing of the contact carrier from a housing cover of a plug connector;

B. Separation of at least two parts of the contact carrier from each other;

C. Removal and/or addition and/or reconnecting of at least one U-shaped contact pin from/to the contact carrier;

D. Joining together of the at least two parts of the contact carrier;

E. Fastening of the contact carrier to the housing cover.

In particular, the method can subsequently include the following additional method steps:

F. Closing of the housing cover and thereby an automatic establishment of an electrically conductive connection between at least two contact sockets by at least one U-shaped contact pin arranged in the contact carrier, and thereby G. Electrically conductive connection of at least two electrical components of the electrical system, wherein each of such components is connected in an electrically conductive manner to one of the at least two contact sockets.

In this manner, the operating state of the electrical system can be changed flexibly, cost-effectively and highly effortlessly, such that, for example, an escalator changes its direction of travel, etc., which represents an additional advantage of the contact carrier. In this case, no additional component is required; rather, only the existing components are arranged differently, with little manual effort.

BRIEF DESCRIPTION OF THE DRAWINGS

An exemplary embodiment is shown in the drawings and is explained in more detail below.

DETAILED DESCRIPTION

The figures partly contain simplified, schematic illustrations. In some cases, identical reference signs are used for the same but possibly non-identical elements. Different views of the same elements could be scaled differently.

Figure 1:
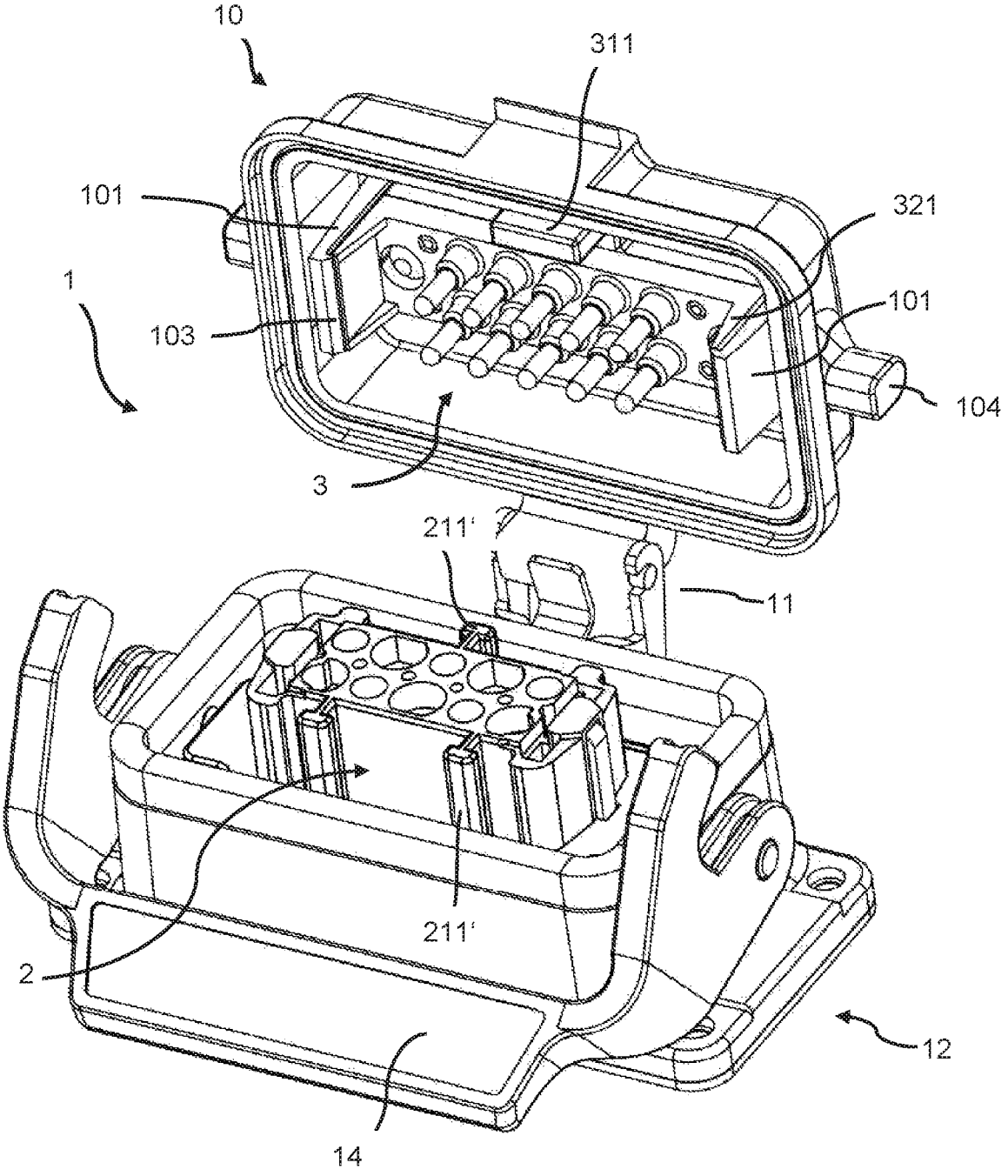
FIG. 1 shows a plug connector having an open housing cover and a contact carrier accommodated therein.

FIG. 1 shows a plug connector with a plug connector housing 1, which has a bulkhead housing 12 with a hinge ii and a housing cover 10 that can be swiveled on it. Furthermore, the plug connector has an insulating body 2 with contact sockets 28, which are not visible in this illustration, along with a locking bracket 14 for locking the possibly closed housing cover 10 to its locking pin 104.

The housing cover 10 accommodates a two-part contact carrier 3, which consists of an upper part 31 and a lower part 32, which have not yet been designated here for reasons of clarity. In the contact carrier 3, U-shaped contact pins 8, 8', 8" are arranged as electrical bridges; these are also not yet designated in this illustration for reasons of clarity.

The contact carrier 3 has a latching arm 321 at each of two opposite ends. The housing cover 10 has two counter-latching arms 101 with latching hooks 103 formed on their free-standing ends. The contact carrier 3, with its latching arms 321, snaps onto this latching hook 103, and is thus held on the housing cover 10.

The contact carrier also has an L-shaped polarization element 311, which engages in a polarization recess of the insulating body 2 when closing the housing cover 10, wherein the polarization recess is formed by two polarization bars 211 bounding it. On its opposite side, the insulating body has a centrally arranged polarization bar 211', which prevents the housing cover 10 from closing if the contact body 3 is aligned incorrectly relative to the insulating body 2.

Figure 2A:
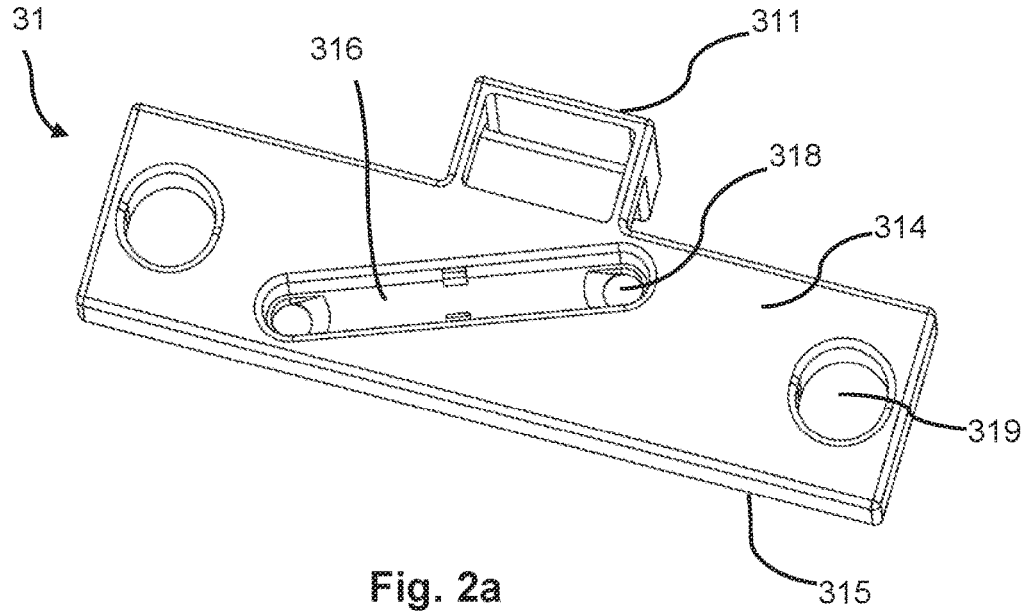
FIG. 2*a, b* shows an upper part and a lower part of the contact carrier.
Figure 2B:
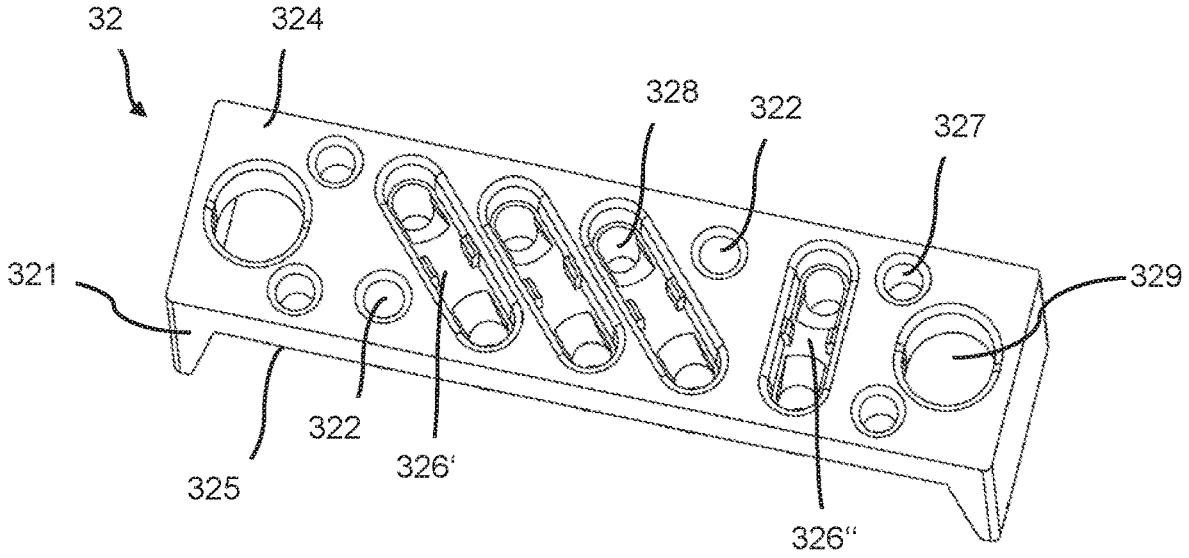

FIGS. 2*a* and 2*b* shows the upper part 31 and the lower part 32 of the contact carrier 3 with a view to their respective contact surfaces 314, 324. Opposite to each other, they each have a plug-in area 315, 325, wherein the respective plug-in areas are designated from this perspective but are actually covered by the upper part 31 or lower part 32 and are therefore not visible.

The upper part 31 has a cuboid basic shape with the L-shaped polarization element 311 formed thereon on the side. In its contact side 314, a first contact support 316 is arranged in the form of an elongated indentation, which is connected at its ends to the contact area 315 through a through-hole 318. In addition, the upper part 31 has slot-shaped, continuous positioning openings 319 near its ends. The cross-section of the positioning openings 319 has two opposite semicircles connected by two short straight sections. Such special cross-sectional shape of the positioning openings 319 serves, as will be explained later, the clearance of the contact carrier 3 in relation to the housing cover 10 as tolerance compensation. When closing the housing cover 10, this allows a slight tilting movement compared to the housing cover 10.

The lower part 32 has such positioning openings 329 that, when joined together with the upper part 31, attach to its positioning openings 319.

Furthermore, the lower part 32 has four contact supports 326', 326" in its contact surface 324, specifically three second contact supports 326' and a third contact support 326", at the ends of which through-openings 328 are also arranged as a connection to the plug-in area 325 of the lower part 32. The third contact support 326" is shorter than the three second contact supports 326'.

In addition, the lower part 32 has additional through-holes 322 that, when joined together with the upper part 31, attach directly to its through-holes 318.

In addition to the two already mentioned latching arms 321, the lower part 32 has positioning recesses 327, which interact with positioning pins 317 of the upper part 31 not yet shown in this illustration, when the upper part 31 is joined together with the lower part 32.

Figure 3A:
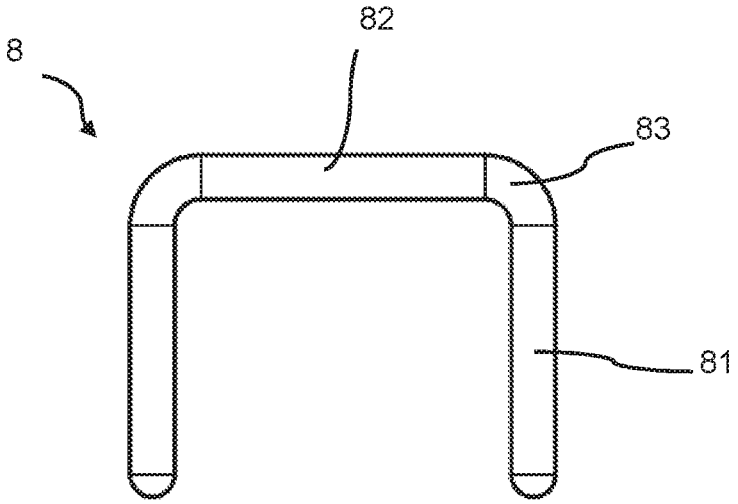
FIG. 3*a, b, c* shows a set of U-shaped contact pins in three different designs.

FIGS. 3*a, b, c* show a set of U-shaped contact pins 8, 8', 8" for insertion into the contact carrier 3. They are made of metal and are bent to their U-shape in order to fulfill the aforementioned bridge function.

This set of U-shaped contact pins 8, 8', 8" is assembled as an example of a specific bridge function and comprises three different designs of the U-shaped contact pins 8, 8', 8", specifically a first contact pin 8, three second contact pins 8' and a third contact pin 8".

Each of the U-shaped contact pins 8, 8', 8" has two parallel end areas 81, 81', 81" on the plug side, a center area 82, 82', 82" extending at right angles to them and a bending area 83, 83', 83" in between. The bending area naturally has a certain curvature.

As can easily be seen from the drawing, the different U-shaped contact pins 8, 8', 8" differ from each other by the length of their center area 83, 83', 83" and/or the length of their end areas 81, 81', 81" on the plug side.

The first contact pin 8 shown in FIG. 3*a* has, compared to the other contact pins 8', 8", relatively long end areas 81 on the plug side, because it is intended for use in the upper part 31, while the other contact pins 81', 81" are intended for use in the upper part 32.

Figure 3B:
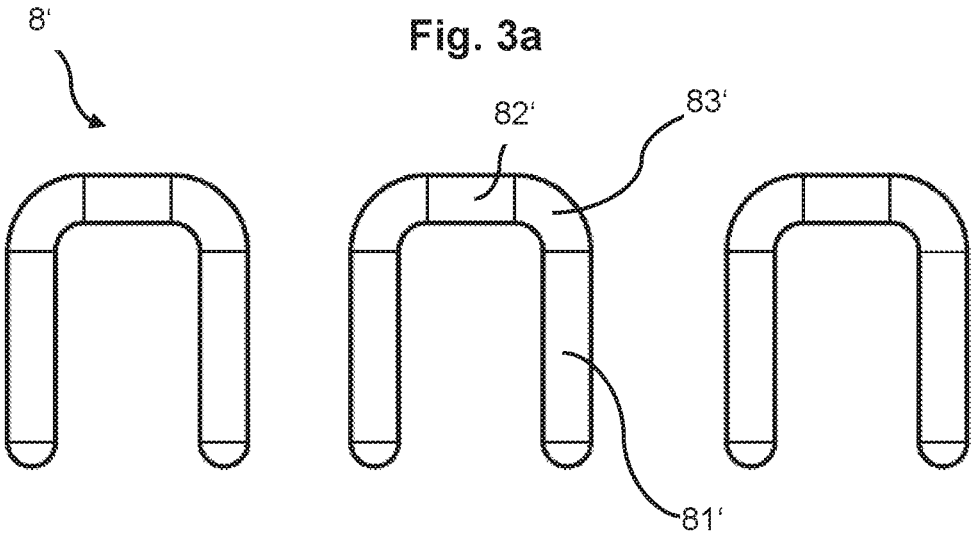

The second contact pin 8' shown in FIG. 3*b* has a center area 82' that is shorter than the center area 82' of the first contact pin 8 and longer than the center area 82" of the third contact pin 8".

Figure 3C:
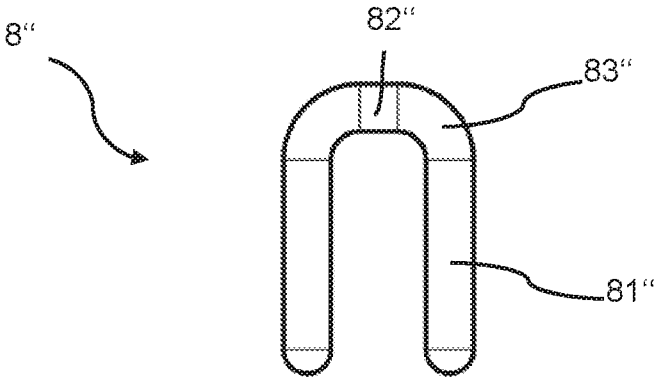

The third contact pin 8" shown in FIG. 3*c* has a center area 82" that is shorter than the center area 8' of the other contact pins 8, 8'.

Of course, a different set of contact pins in number and shape can be combined for another desired bridge function.

Figure 4A:
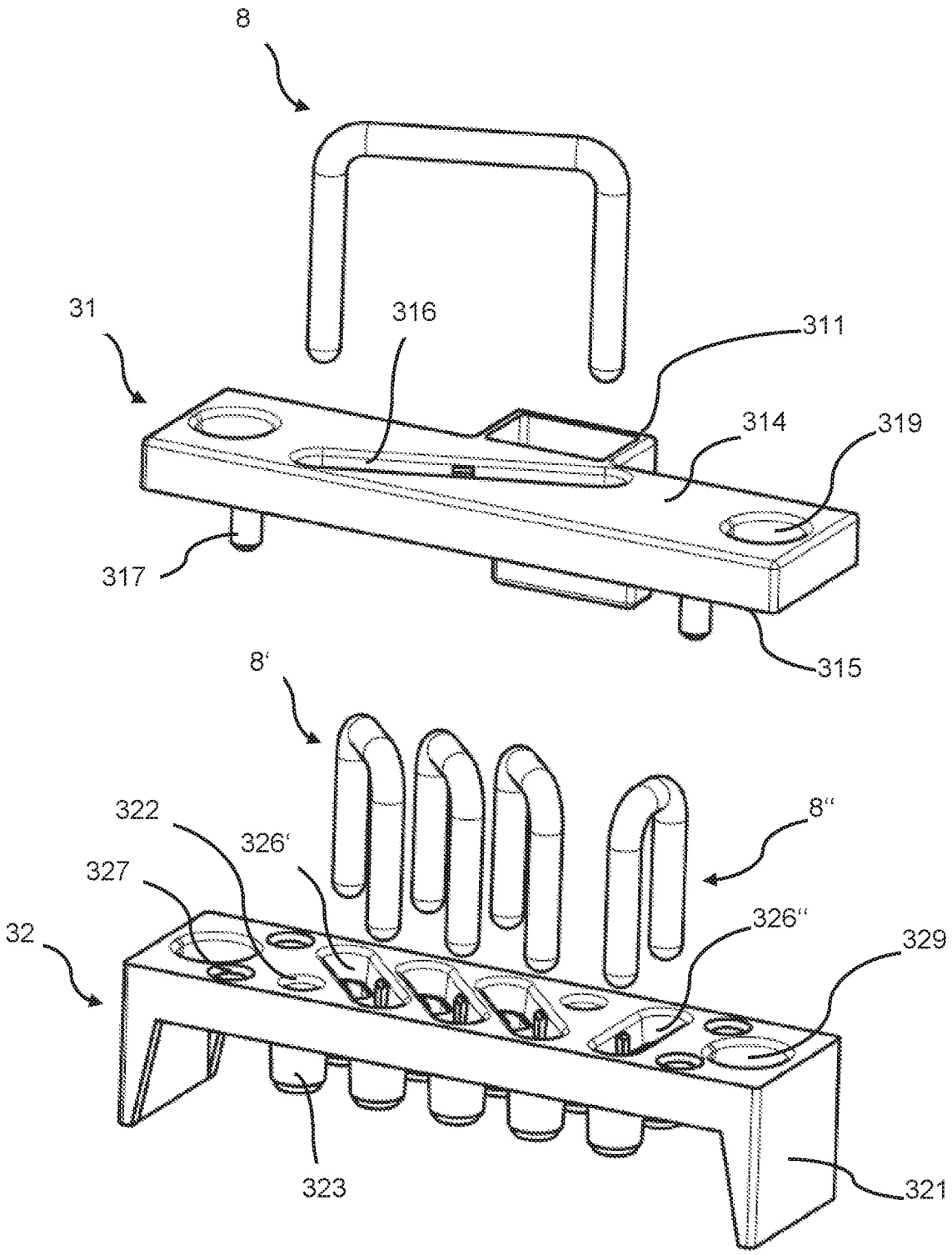
FIG. 4*a, b, c* shows the contact carrier in an exploded view, during assembly and in the assembled state.

FIG. 4*a, b, c* show the contact carrier 3 together with the contact pins 8, 8', 8".

FIG. 4*a* shows this arrangement in an exploded view. Therein, the upper part 31 and the lower part 32 are shown separately and in each case with the U-shaped contact pin(s) 8, 8', 8" arranged above and to be inserted into them.

It is easy to see that the first contact element 8 is intended to be arranged with its center area 82 in the first contact support 316. Furthermore, it is obvious that the second and third contact elements 8', 8" are intended to be arranged with their respective center areas 82', 82" in the second or third contact support 316", 316" respectively.

This illustration also shows two positioning pins 317 of the upper part 31, of which only one is designated for reasons of clarity. The upper part 31 has two additional such positioning pins 317 symmetrically arranged for this purpose; these are not shown in this illustration. However, it is easily conceivable that such four positioning pins 317 are inserted into the corresponding, slightly funnel-shaped positioning recesses 327 of the lower part 32 when the upper part 31 and the lower part 32 are joined together, in order to ensure the exact positioning of the joined upper part 31 and lower part 32.

Figure 4B:
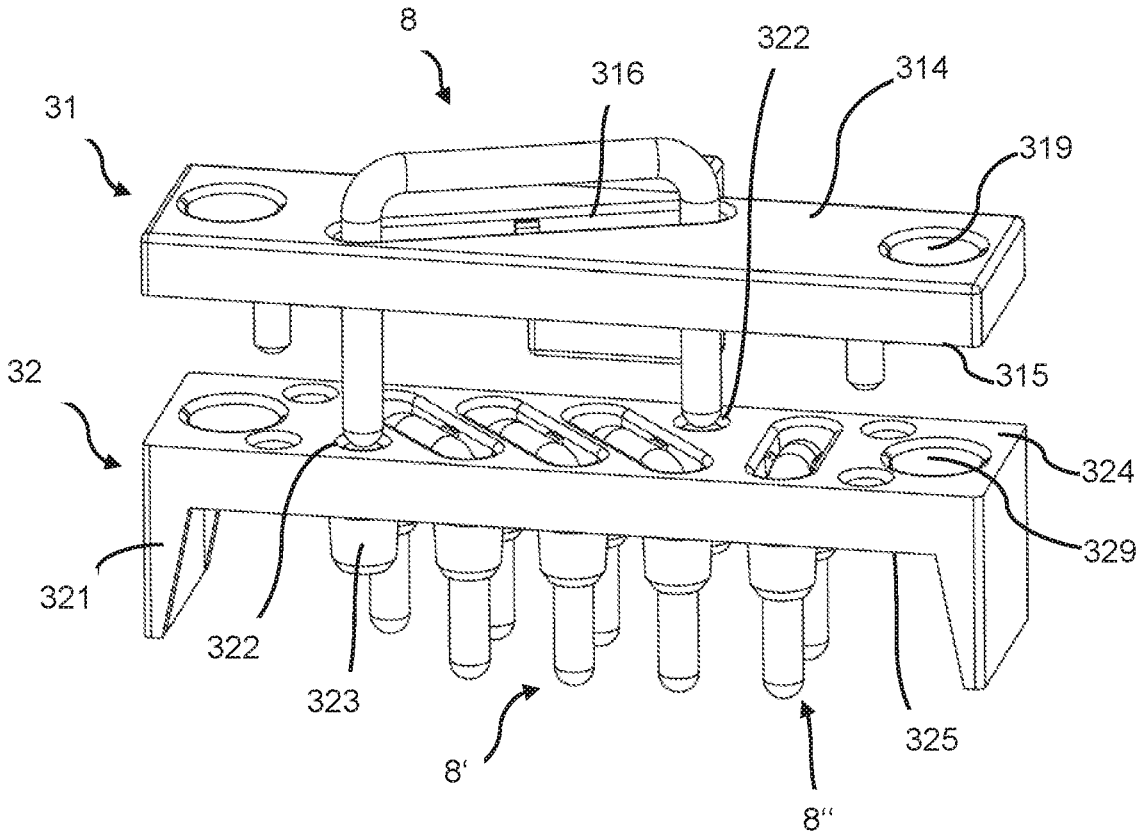
FIG. 4*d, e* shows the contact carrier with a cover in a separated and assembled state.

FIG. 4*b* shows upper part 31 and lower part 32 during the process of mutually joining them together. The second contact pin 8' and third contact pin 8" are already inserted in the lower part 32; that is, their respective center areas 82', 82" are arranged in the second contact supports 326" and third contact supports 326" and their end areas 81', 81" on the plug side are guided through the corresponding through-holes 328 and the corresponding hollow-cylindrical formations 323 of the plug-in area 325 of the lower part 32.

The first contact element 8 is just in the process of being inserted with its center part 82 into the first contact support 316 of the upper part 31. Its end areas 81 on the plug side are already guided through the corresponding through-holes 318 of the upper part 31 and are about to be inserted into the additional through-holes 322 of the upper part 32.

Figure 4C:
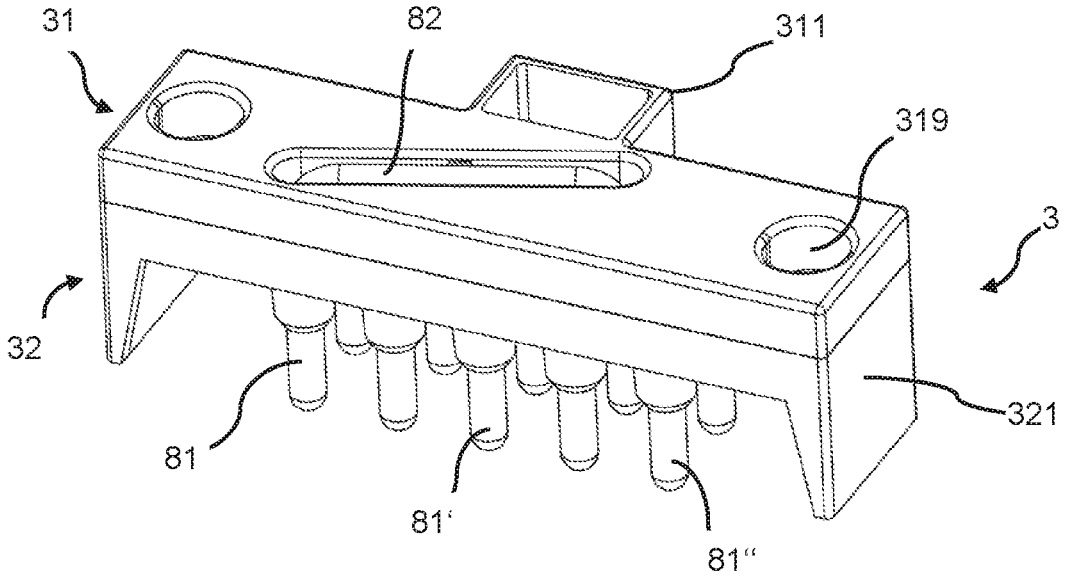

FIG. 4*c* shows the contact carrier 3 joined from the upper part 31 and the lower part with the U-shaped contact pins 8, 8', 8" inserted in it. The positioning openings 319, 329 of the upper part 31 and of the lower part 32 come to lie on top of each other.

Figure 4D:
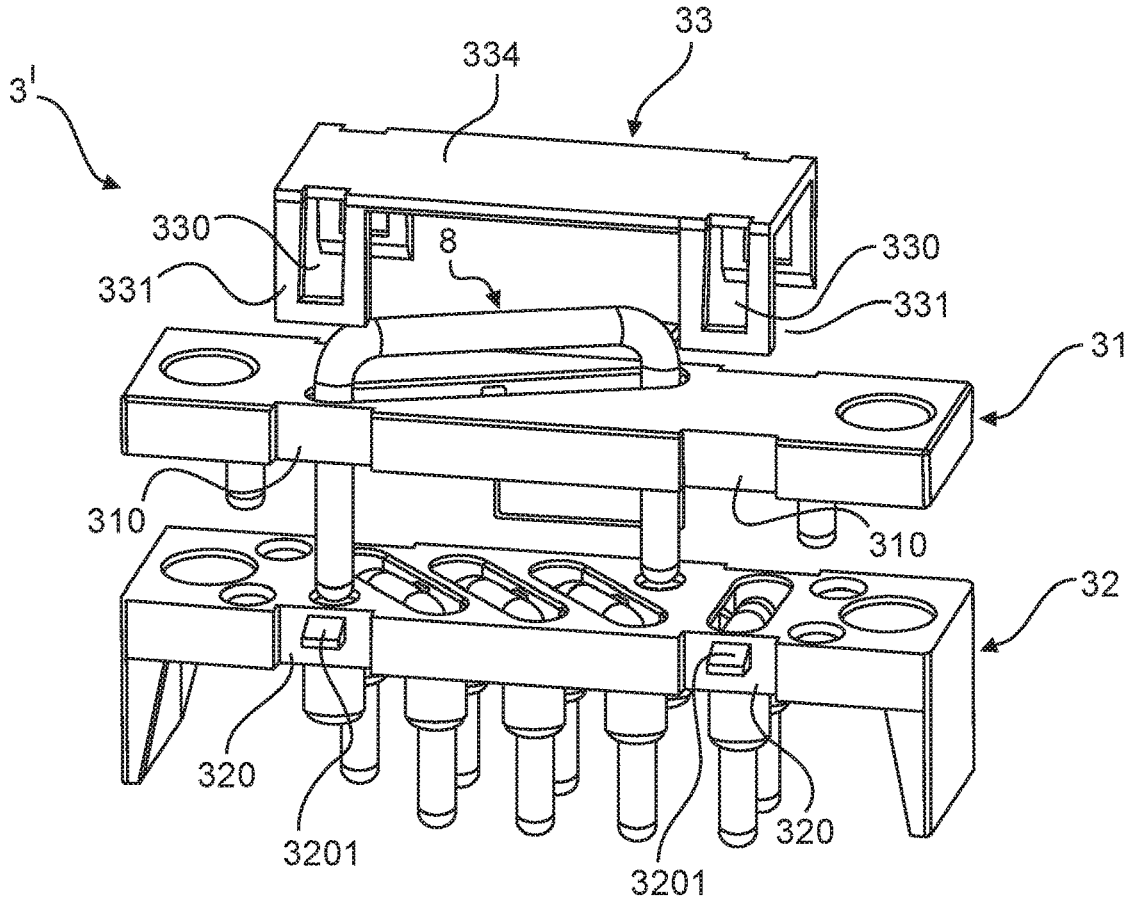

FIG. 4*d* shows the contact carrier 3 in a slightly modified design. The upper part 31 has four feed-through inlets 310. The lower part 32 has four latching inlets 320, each with a latching formation 3201 arranged in them.

In addition, the contact carrier 3 has a cover 33. The cover 33 has a rectangular protective surface 334 along with fastening clips 331, which are formed onto the protective surface 334 and each of which has a latching window 330.

Figure 4E:
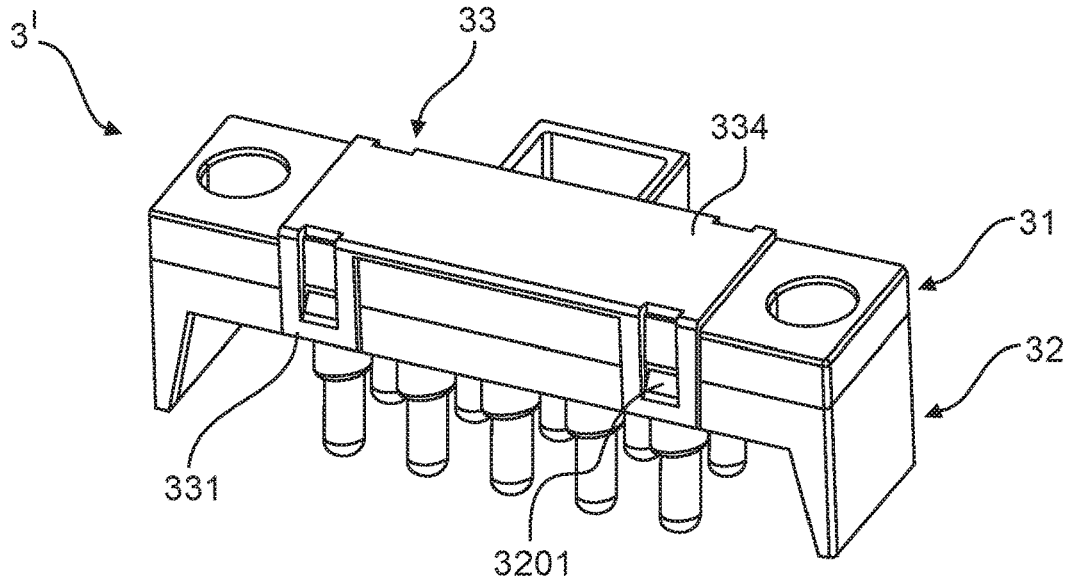

FIG. 4*e* shows the assembled contact carrier 3'. The cover 33 with its protective surface 334 is arranged on the upper part 31 and thus covers the U-shaped contact pin 8 extending through the first contact support 316 of the upper part 31. The fastening clips 331 are guided through the feed-through inlets 310 of the upper part 31, engage in the latching inlets 320 of the lower part 32 and latch with their latching windows 330 to the latching formations 3201 of the lower part 32. Thus, the cover 33 can be attached to the upper part 31 and fixed to the lower part 32.

The aforementioned U-shaped contact pin 8, which extends through the upper part 31, could, for example, lead to a high electrical voltage in some applications. Normally, this would be harmless, because the contact carrier 3 is fixed in the housing cover 10 at the same time and contact pin 8 is therefore not accessible. However, in the case of damage and/or faulty operation, there could be a danger of, for example, manual contact with such contact pin 8. This is safely avoided with the contact carrier 3" in the present design by the electrically insulating protective surface 334 of the cover 33. In this manner, the cover 33 can attach both to itself and the upper part 31 to the lower part 32. Thus, the cover 33 has a double function, as it is used for mechanical fastening and also for electrical safety. The latter applies in particular if the contact carrier 3" is bonded in the assembled state.

Figure 5B:
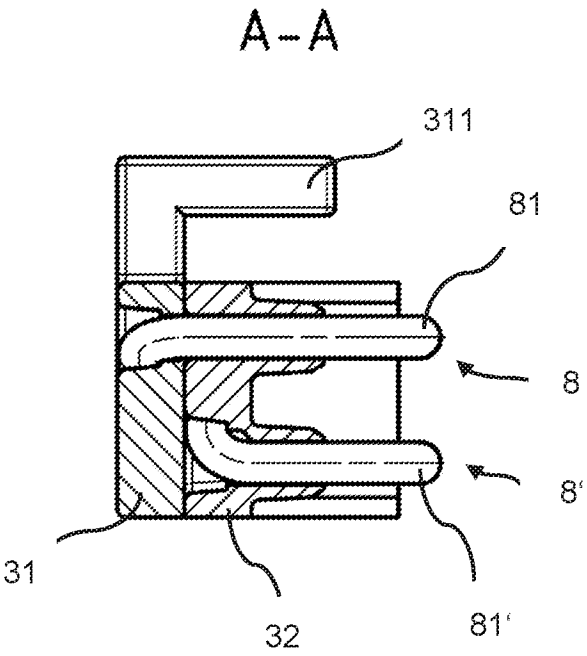
FIG. 5*a, b* shows the contact carrier equipped with the U-shaped contact pins from below and in cross-section.
FIG. 5*c, d, e* shows the equipped lower part in a top view and a side view and in cross-section.
Figure 5A:
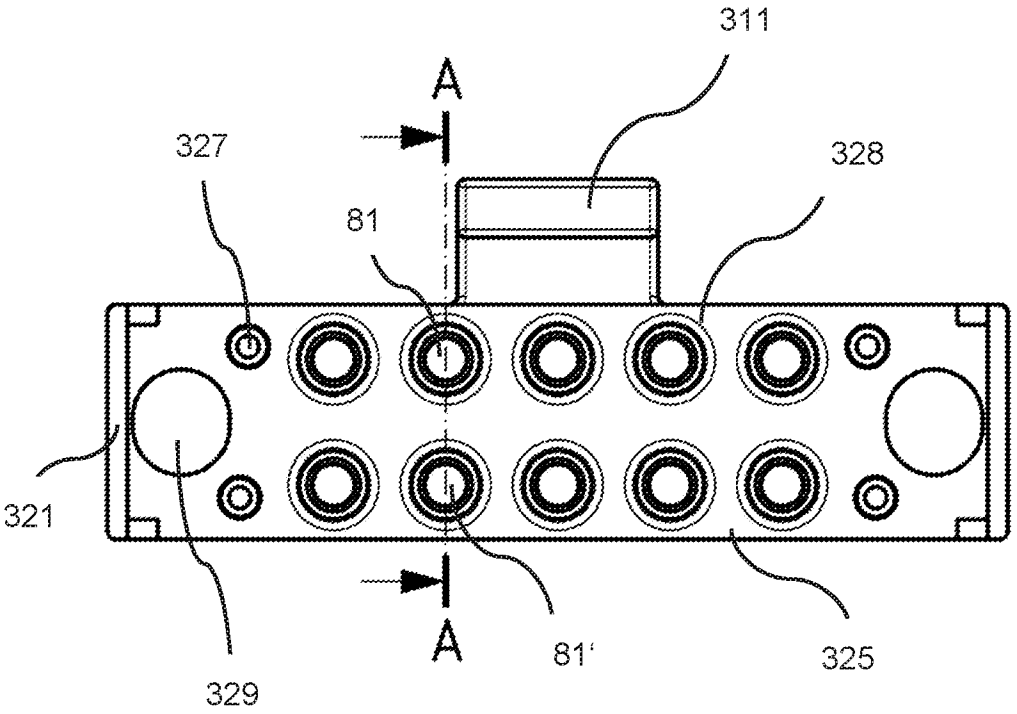

FIG. 5*a* shows this arrangement from the direction of the plug-in area 325. In this view, the slot-shaped cross-sectional shape of the positioning opening 319 of the upper part 31 can also be seen particularly easily.

FIG. 5*b* shows the same object in cross-section through a cross-sectional area A. Thereby, both the first U-shaped contact pin 8" and a second U-shaped contact pin 8" with the respective end area 81, 81" on the plug side can be clearly seen.

Figure 5C:
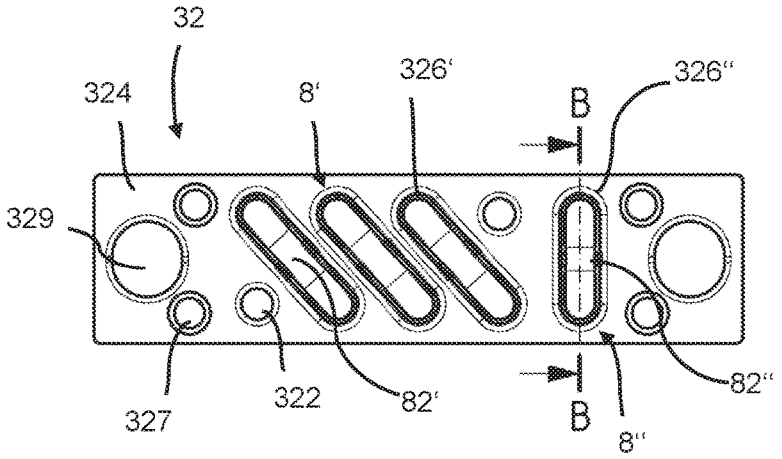

FIG. 5*c* shows the lower part 32 equipped with the corresponding U-shaped contact pins 8", 8" with a view to its contact surface 4. In this view, the slot-shaped cross-sectional shape of the positioning opening 329 of the lower part 32 can also be seen particularly easily.

Figure 5D:
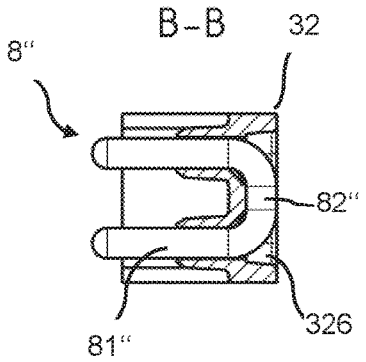

FIG. 5*d* shows the same object in cross-section through a cross-sectional area B, which extends through the third contact support 326".

Figure 5E:
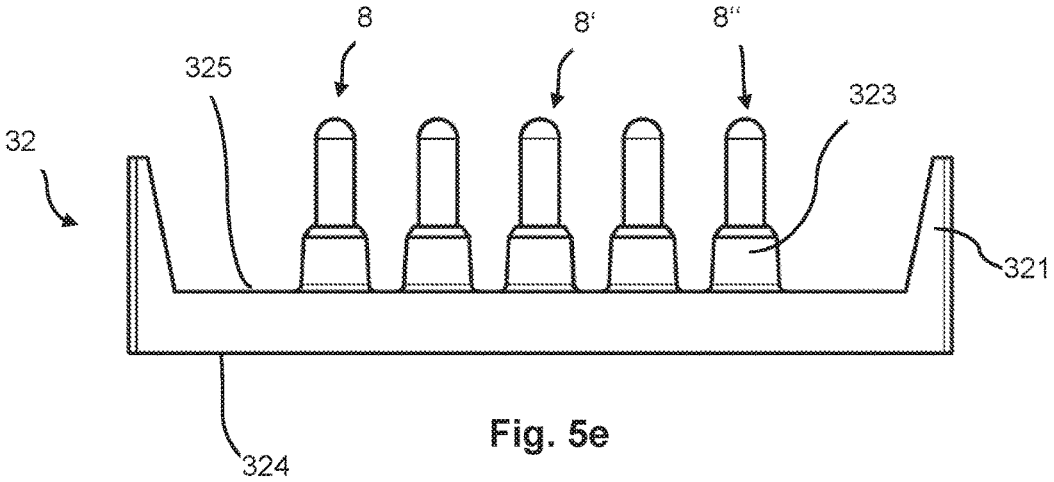

In FIG. 5*e*, the equipped lower part 32 is shown in a side view.

Figure 6A:
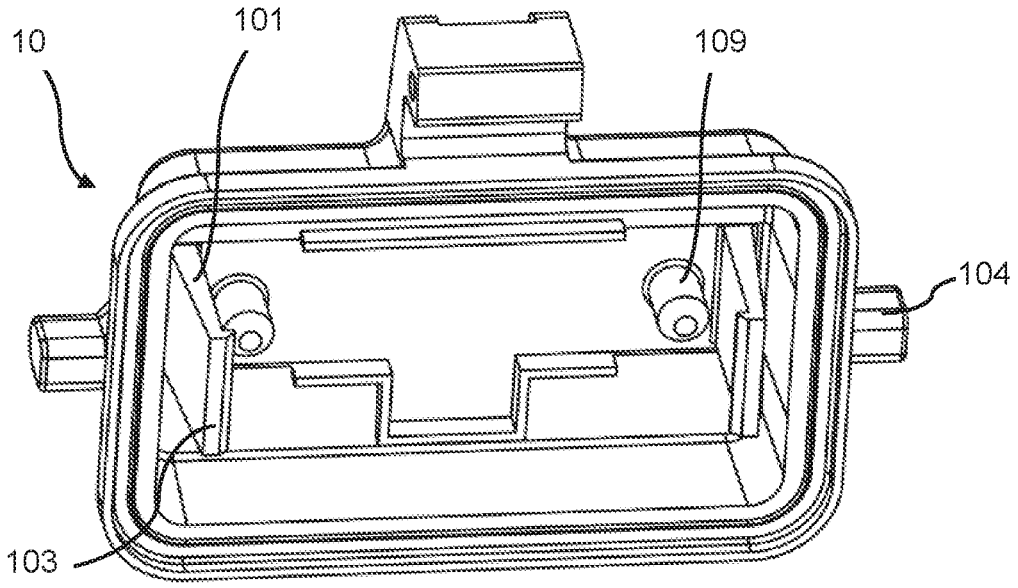
FIG. 6*a*, 6*b* shows the housing cover without and with the contact carrier accommodated in it.

FIG. 6*a* shows the housing cover 10 without the contact carrier 3. This makes its positioning pins 109 and its latching hooks 101 with the latching pins 103 formed thereon visible with particular ease. The positioning pins 109 have a section that is cylindrical; that is, circular in cross-section.

Figure 6B:
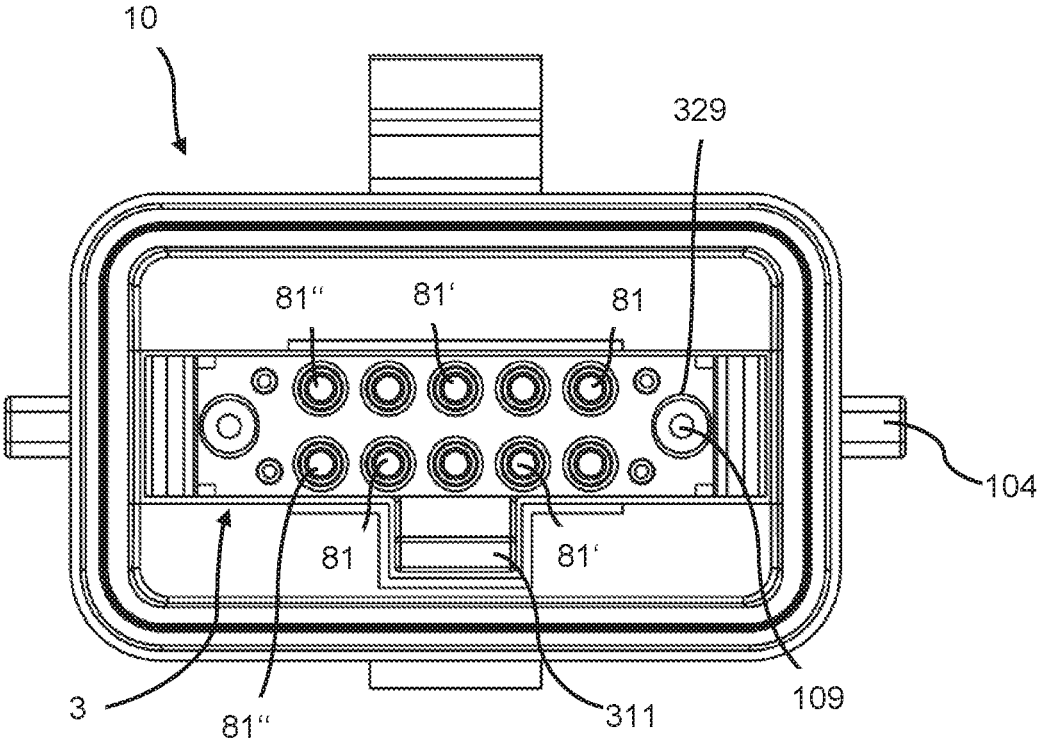

FIG. 6*b* shows such housing cover 10 with the contact carrier 3 inserted in it and the U-shaped contact pins 8, 8', 8" accommodated in it as contact bridges. It can be seen from this view that the positioning pin 329 is designed to be slot-shaped, while the cross-section of the positioning pin 109 is circular at least in its corresponding cylindrical section. The resulting play enables a slight tilting movement of the contact carrier 3 in or against the swivel direction of the housing cover 10 as tolerance compensation when opening and closing the housing cover 10.

Figure 6C:
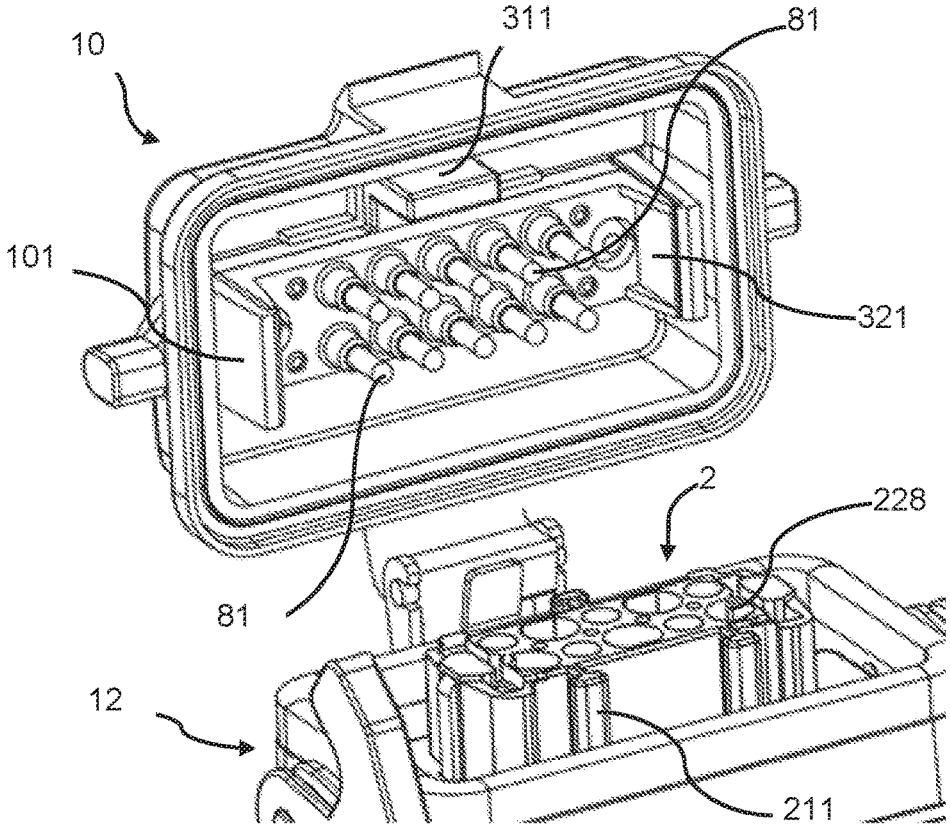
FIG. 6*c, d, e* shows the plug connector equipped with the contact carrier with an open housing cover in three different views.

FIG. 6*c* shows the advantage of such a tolerance compensation. If the housing cover 10 is closed (that is, swiveled onto the bulkhead housing 12), the ends 81 on the plug side of the U-shaped contact pins 8 are inserted into the socket recesses 228 of the insulating body 2, where they inevitably undergo a longitudinal movement that, together with the simultaneous swivel movement of the housing cover 10, would normally cause mechanical stresses. However, such stresses are avoided by the tolerance between the contact carrier 3 and the housing cover 10, specifically by the slight tilting movement of the contact carrier 3 in relation to the housing cover 10.

Figure 6D:
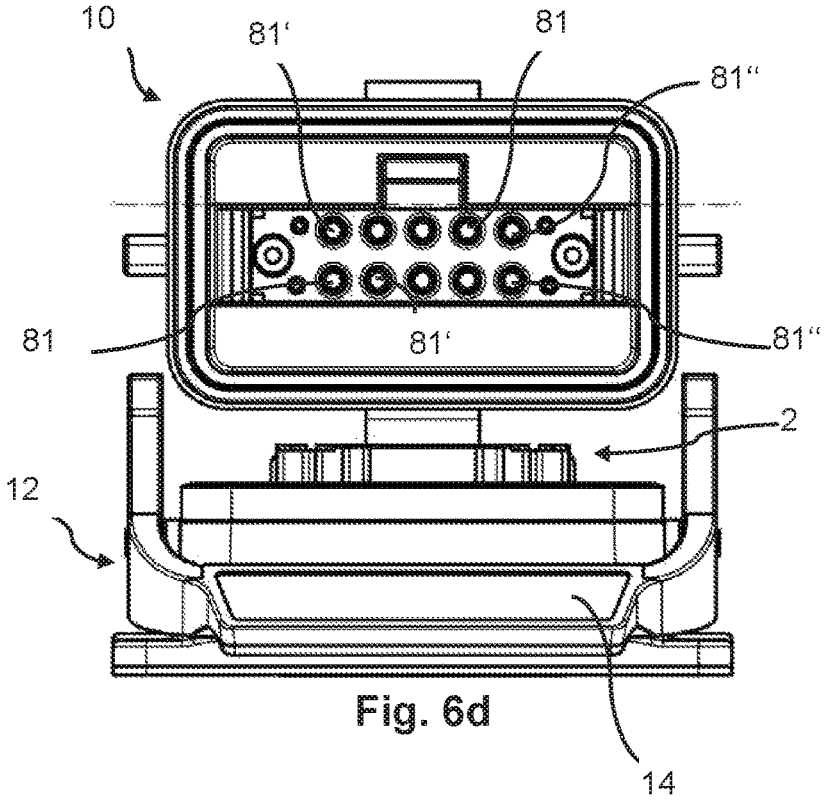
FIG. 6*f* shows the plug connector with a closed housing cover.
Figure 6E:
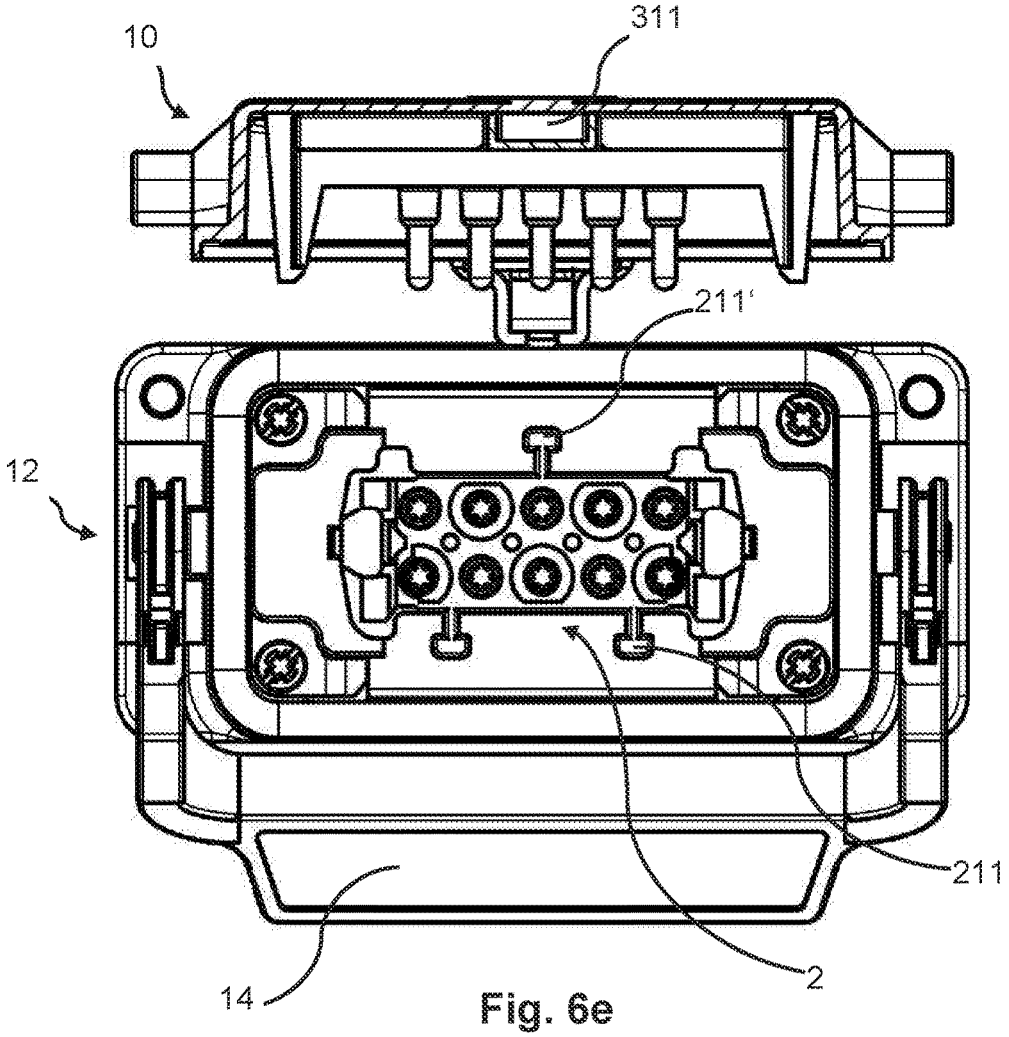
Figure 6F:
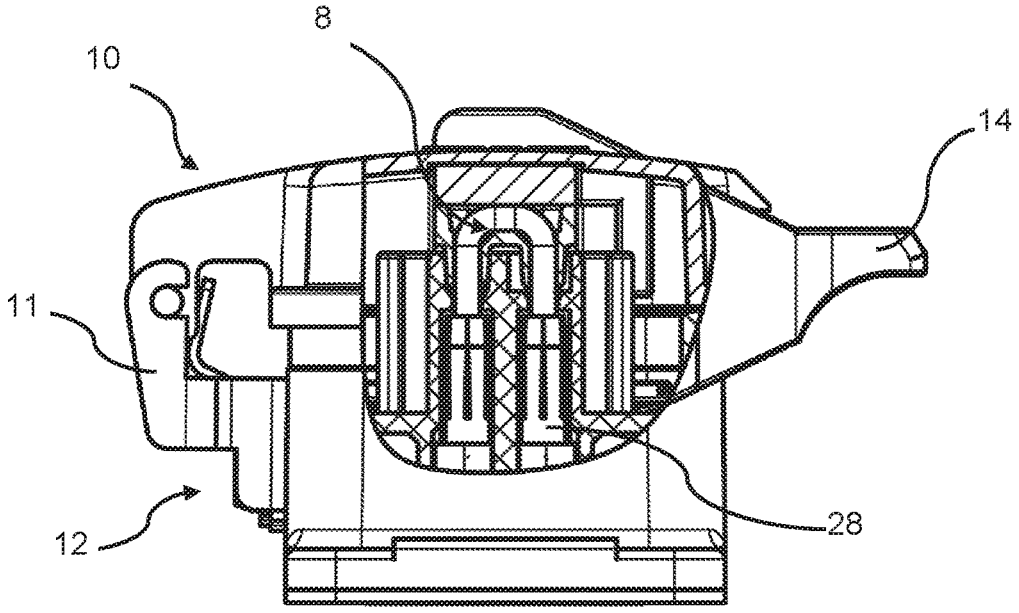

FIG. 6*d* and FIG. 6*f* show the same arrangement in a front view and a top view.

FIG. 6*f* shows this arrangement with a closed housing cover in the lateral cross-section through the third contact support 326" of the contact carrier 32. The contact sockets 28 are shown and marked for the first time. It is easy to see that the third U-shaped contact pin 8" connects two opposite contact sockets 28 with each other in an electrically conductive manner.

On the cable connection side, the contact sockets 28 can be attached, for example, to electrical components of an electrical system, which means that such components are short-circuited.

If the third contact pin 8" is then removed from the contact carrier, which is only possible with little effort, such bridge is no longer present and the two specified electrical components of the electrical system are no longer short-circuited even when the housing cover 10 is closed. Of course, additional jumpers can remain in the contact carrier 3 and thus continue to short-circuit other electrical components of the system. This allows the operating state of the electrical system to be changed in a particularly convenient manner and without the need for additional components.

When the housing cover 10 is snapped shut, the correct orientation between the insulating body 2 and the contact carrier 3 is ensured by the L-shaped polarization element 311 and by at least one polarization bar 211" of the insulating body 2.

Even if different aspects or features of the invention are shown in combination in the figures, it is clear to the expert—unless otherwise stated—that the combinations shown and discussed are not the only possible combinations. In particular, units or feature complexes that correspond to each other from different exemplary embodiments can be exchanged with each other.

LIST OF REFERENCE SIGNS

1 Plug connector housing
10 Housing cover
101 Counter-latching arms
103 Latching hook
104 Locking pin
109 Positioning pin
11 Hinge
12 Bulkhead housing
14 Locking bracket
2 Insulating body
211, 211" Polarization bar
228 Socket recess
28 Contact socket
3,3" Contact carrier
31 Upper part
310 Feed-through inlet
311 Polarization element
314 Contact surface of the upper part
315 Plug-in area of the upper part
316 First contact support
317 Positioning pins
318 Through-holes of the upper part
319 Positioning openings of the upper part
32 Lower part
320 Latching inlet
3201 Latching formation
321 Latching arms
322 Additional through-holes
323 Hollow-cylindrical formations
324 Contact surface of the lower part
325 Plug-in area of the lower part
326', 326" Second, third contact support(s)
327 Positioning recesses
328 Through-holes of the upper part
329 Positioning openings of the lower part
33 Cover
330 Latching window
331 Fastening clips
334 Protective surface
8, 8', 8" First, second third U-shaped contact pins
81, 81', 81" End areas on the plug side of the U-shaped contact pins
82, 82', 82" Center areas of U-shaped contact pins
83, 83', 83" Bending area of the contact pins

The invention claimed is:

1. A contact carrier for accommodating a plurality of U-shaped contact pins for producing jumpers, wherein the contact carrier is configured to be releasably fastened in or on a housing cover of a plug connector, and wherein the contact carrier has polarization elements and latching elements for its polarization relative to an insulating body of the plug connector and for its latching and unlatching on the housing cover.

2. The contact carrier according to claim 1, wherein the contact carrier comprises at least two parts.

3. The contact carrier according to claim 2, wherein the at least two parts include an upper part, and a lower part, each of which has a contact surface and a plug-in area, the contact surface and the plug-in area being on opposite sides of the part, wherein in each of the two contact surfaces at least one elongated indentation is arranged as a contact support.

4. The contact carrier according to claim 3, wherein the contact carrier includes at least a third part consisting of a cover having a protective surface for covering the at least one contact support of the upper part.

5. The contact carrier according to claim 4,
wherein the cover can be attached to the upper part and fastened to the lower part.

6. The contact carrier according to claim 3,
wherein both the upper part and the lower part have through-holes for contact passage at ends of each contact support.

7. The contact carrier according to claim 4,
wherein the upper part and the lower part can be joined together,
wherein, in a joined state, the plug-in area of the upper part is in mechanical contact with the contact surface of the lower part, and
wherein the lower part has additional through-holes, which, in the joined state, align with the through-holes of the upper part.

8. The contact carrier according to claim 7,
wherein the upper part and the lower part have latching elements for mutual latching and unlatching and/or positioning elements for mutual positioning in the joined state.

9. The contact carrier according to claim 6,
wherein the lower part, at the through-holes on its plug-in area, has hollow-cylindrical formations for mechanical guidance and better electrical insulation of the contact pins.

10. An arrangement comprising the contact carrier according to claim 1 and a plurality of contact pins arranged therein,
wherein the contact pins each have a center area and two end areas on a plug side bent over bending areas at right angles to the center.

11. The arrangement according to claim 10, wherein at least two of the plurality of contact pins differ in a length of their center areas and/or in a length of their end areas.

12. The arrangement according to claim 10,
wherein the contact carrier has two parts that can be joined together, specifically an upper part and a lower part, each having on opposite sides a contact surface and a plug-in area,
wherein in each of the contact surfaces at least one elongated indentation is arranged as a contact support,
wherein both the upper part and the lower part at ends of each contact support have through-holes for contact passage,
wherein each of the contact pins is arranged with its respective center area either in the contact support of the upper part or in the contact support of the lower part and with its end areas on the plug side is inserted through the through-holes of the upper part and/or of the lower part, and
wherein the end areas on the plug side project from the plug-in area of the lower part.

13. The arrangement according to claim 12,
wherein the contact pins, the center area of which is arranged in one of the contact supports of the lower part, are fixed in the contact carrier counter to their plug-in direction by joining together the lower part and the upper part.

14. A system of a plug connector and an arrangement according to claim 10, wherein the plug connector comprises:
a bulkhead housing with a housing cover that can be snapped open and shut;
an insulating body with contact sockets arranged therein; and
a locking mechanism for locking the housing cover in a snapped-shut state,
wherein the contact carrier is releasably fixed in the housing cover.

15. The system according to claim 14,
wherein the contact carrier can be latched in the housing cover.

16. The system according to claim 15,
wherein the contact carrier has latching arms that can be releasably latched to counter-latching arms of the housing cover.

17. The system according to claim 14,
wherein, by snapping shut the housing cover, at least one U-shaped contact pin is inserted into at least two of the contact sockets, in order to connect them to each other in an electrically conductive manner.

18. The system according to claim 17,
wherein the contact carrier is movably fixed in the housing cover within a specified mechanical tolerance range, in order to enable the housing cover of the plug connector housing to be snap shut without generating undesired mechanical stresses, even while the at least one U-shaped contact pin is inserted at least partially into the at least two contact sockets of the insulating body on the plug side.

19. A method for changing an operating state of an electrical system, comprising the following method steps:
providing the contact carrier as in claim 2;
releasing the contact carrier from a housing cover of a plug connector;
separating the at least two parts of the contact carrier from each other;
removing at least one U-shaped contact pin from the contact carrier or adding at least one U-shaped contact pin to the contact carrier;
joining together the at least two parts of the contact carrier; and
fastening the contact carrier to the housing cover.

20. The method according to claim 19, further comprising:
closing the housing cover and thereby automatically establishing an electrically conductive connection between at least two contact sockets by least one U-shaped contact pin arranged in the contact carrier, and thereby
establishing an electrically conductive connection of at least two electrical components of an electrical system, wherein each of the components is connected in an electrically conductive manner to one of the at least two contact sockets.

21. A system, comprising:
a contact carrier for accommodating a plurality of U-shaped contact pins for producing jumpers;
a plurality of contact pins arranged in the contact carrier;
a plug connector, comprising
a bulkhead housing with a housing cover that can be snapped open and shut,
an insulating body with contact sockets arranged therein, and
a locking mechanism for locking the housing cover in a snapped-shut state,
wherein the contact carrier is releasably fixed in the housing cover,
wherein the contact pins each have a center area and two end areas on a plug side bent over bending areas at right angles to the center, wherein the contact carrier can be latched in the housing cover, and wherein the contact carrier has latching arms that can be releasably latched to counter-latching arms of the housing cover.

* * * * *